US010596430B1

(12) United States Patent
Paavola

(10) Patent No.: US 10,596,430 B1
(45) Date of Patent: Mar. 24, 2020

(54) PUTTING GREEN REPAIR ACCESSORY WITH SLOPE INDICATING FEATURE

(71) Applicant: Dean Curtis Paavola, Maricopa, AZ (US)

(72) Inventor: Dean Curtis Paavola, Maricopa, AZ (US)

(73) Assignee: Dean C Paavola, Tucson, AZ (US)

( * ) Notice: Subject to any disclaimer, the term of this patent is extended or adjusted under 35 U.S.C. 154(b) by 0 days.

(21) Appl. No.: 16/283,810

(22) Filed: Feb. 24, 2019

Related U.S. Application Data

(60) Provisional application No. 62/636,752, filed on Feb. 28, 2018.

(51) Int. Cl.

| | |
|---|---|
| ***A63B 57/50*** | (2015.01) |
| ***A63B 57/35*** | (2015.01) |
| ***A63B 57/30*** | (2015.01) |
| *A63B 102/32* | (2015.01) |

(52) U.S. Cl.
CPC ..... *A63B 57/50* (2015.10); *A63B 57/35* (2015.10); *A63B 57/353* (2015.10); *A63B 2102/32* (2015.10); *A63B 2209/08* (2013.01); *A63B 2220/18* (2013.01)

(58) Field of Classification Search
CPC ..... A63B 57/50; A63B 57/353; A63B 57/35; A63B 2102/32; A63B 2209/08; A63B 2220/18
USPC ..... 473/406, 408
See application file for complete search history.

(56) References Cited

U.S. PATENT DOCUMENTS

| | | | | |
|---|---|---|---|---|
| 5,419,551 A * | 5/1995 | Hoyt | A63B 57/00 | 473/406 |
| 6,030,298 A * | 2/2000 | Tate | A63B 57/50 | 473/408 |
| 6,162,137 A * | 12/2000 | Jones | A24F 13/26 | 30/109 |
| D438,587 S * | 3/2001 | Schmitt, Jr. | D21/793 | |
| 6,565,458 B1 * | 5/2003 | Cameron | A63B 57/50 | 473/408 |

(Continued)

FOREIGN PATENT DOCUMENTS

WO WO-2019031740 A1 * 2/2019

OTHER PUBLICATIONS

Machine Translation of WO 2019031740, inventor Ko Tea Young, "Multifunctional Golf Equipment", Published Feb. 14, 2019, pp. 1-11. (Year: 2019).*

*Primary Examiner* — Steven B Wong

(57) ABSTRACT

A multi-function divot repair tool that includes a central body with at least one tine protruding from one end with an adjacent non-tined end, thereby providing the ability to repair putting green divots. The central body houses a rolling-element bearing that is fixedly attached such that one portion of the bearing is able to rotate independently from the central body. Additionally, at least one pedestal is coupled with the independently rotating portion of the rolling-element bearing. The combination thereby providing a divot repair tool that, when the pedestal is in contact with the putting green surface, uses gravitational forces to rotate the central body to align with and thereby indicate the general direction of the putting green slope in the vicinity of the tool. By combining functions, putting skill can be increased without the burden of extra equipment.

24 Claims, 9 Drawing Sheets

(56) References Cited

U.S. PATENT DOCUMENTS

| | | | | |
|---|---|---|---|---|
| 2003/0207730 | A1* | 11/2003 | Braithwaite | A63B 57/207<br>473/408 |
| 2005/0101416 | A1* | 5/2005 | Tiefel | A63B 57/207<br>473/408 |
| 2012/0065002 | A1* | 3/2012 | Cameron | A63B 57/50<br>473/408 |
| 2018/0353830 | A1* | 12/2018 | Jacques | A63B 69/3676 |

* cited by examiner

PUTTING GREEN REPAIR ACCESSORY WITH SLOPE INDICATING FEATURE

FIELD OF THE INVENTION

The present invention relates to novel green repair tools and training aids used in the development of golf putting skill. More particularly, the invention relates to a golf accessory that combines the capability to repair damage to putting greens and the ability to indicate the general direction of putting green slope in the vicinity of the accessory when placed onto the putting surface.

BACKGROUND

In the game of golf, the putting green is the focal point of each hole where the golfer utilizes their training and experience to putt the ball into the cup in as few strokes as possible. Success relies on many factors, two of which are the condition of the putting green surface and the golfer's ability to read the undulations and slope of the green in order to predict a path along which to putt the golf ball.

Green repair tools have long been combined into multi-function golf accessories capable of performing a wide variety of related and unrelated activities. For example, a green repair tool has been combined with a cigar cutter into a single accessory. Obtaining in-situ information about the putting green without the burden of added equipment improves the quality of practice time thereby elevating one's putting skill.

Therefore, a need exists in the field for a novel green repair tool which incorporates a feature that can indicate the direction of the slope in the vicinity of the tool when placed upon the putting green surface.

BRIEF SUMMARY OF THE INVENTION

The present invention comprises a novel putting green repair accessory with a slope indicating feature generally consisting of a putting green repair tool body with at least one protruding tine, a rolling-element bearing with inner and outer races, and at least one pedestal that couples with a freely rotating race of the rolling-element bearing. In the preferred embodiment the outer race of the rolling-element bearing is grounded to the putting green repair tool body thereby allowing the pedestal and inner race of the rolling-element bearing to rotate independently of the green repair accessory body and vice versa.

BRIEF DESCRIPTION OF THE DRAWINGS

Some embodiments of the present invention are illustrated as an example and are not limited by the figures of the accompanying drawings, in which like references may indicate similar elements and in which:

FIG. 3A shows a side section view of the preferred embodiment illustrating the assembled configuration of a putting green repair accessory with slope indicating feature. Additionally, the figure illustrates the spatial relationship between the vertical axis of rotation and the accessory center of mass (CoM).

FIG. 5A—FIG. 5A illustrates an alternative embodiment wherein the accessory CoM is located between the vertical axis of rotation and the tined end of the elongate body. FIG. 5B—FIG. 5B illustrates the complete view of the alternative embodiment of a putting green repair accessory including the location of the accessory CoM.

FIG. 6B illustrates yet another embodiment wherein humorous quotes, sayings or words are applied to the first pedestal that is coupled with the rotationally free race of the rolling-element bearing. The first pedestal can then be swiped with a finger to start the rotation.

FIG. 7A is a sectioned side view illustrating how the second and first pedestals couple to form the journal which establishes the vertical axis of rotation about which the elongate body can rotate. FIG. 7B is an embodiment of the putting green repair accessory where the elongate body comprises a through hole in lieu of a recessed pocket.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases, all of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New combination green repair tool and slope indicating accessories are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

Figure 1:
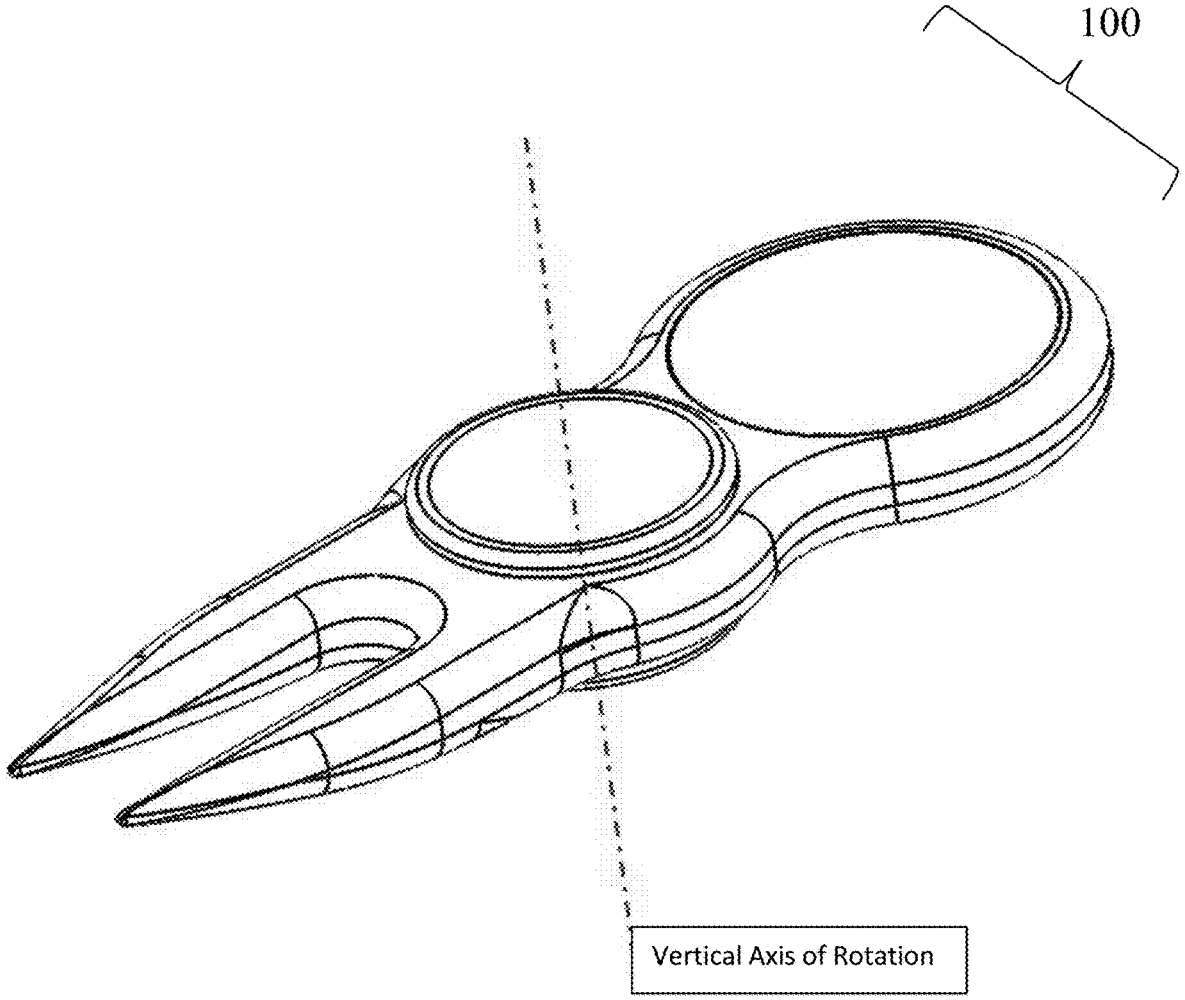
FIG. 1—FIG. 1 depicts a perspective view of the preferred embodiment of a combination putting green repair accessory with slope indicating feature.
Figure 2:
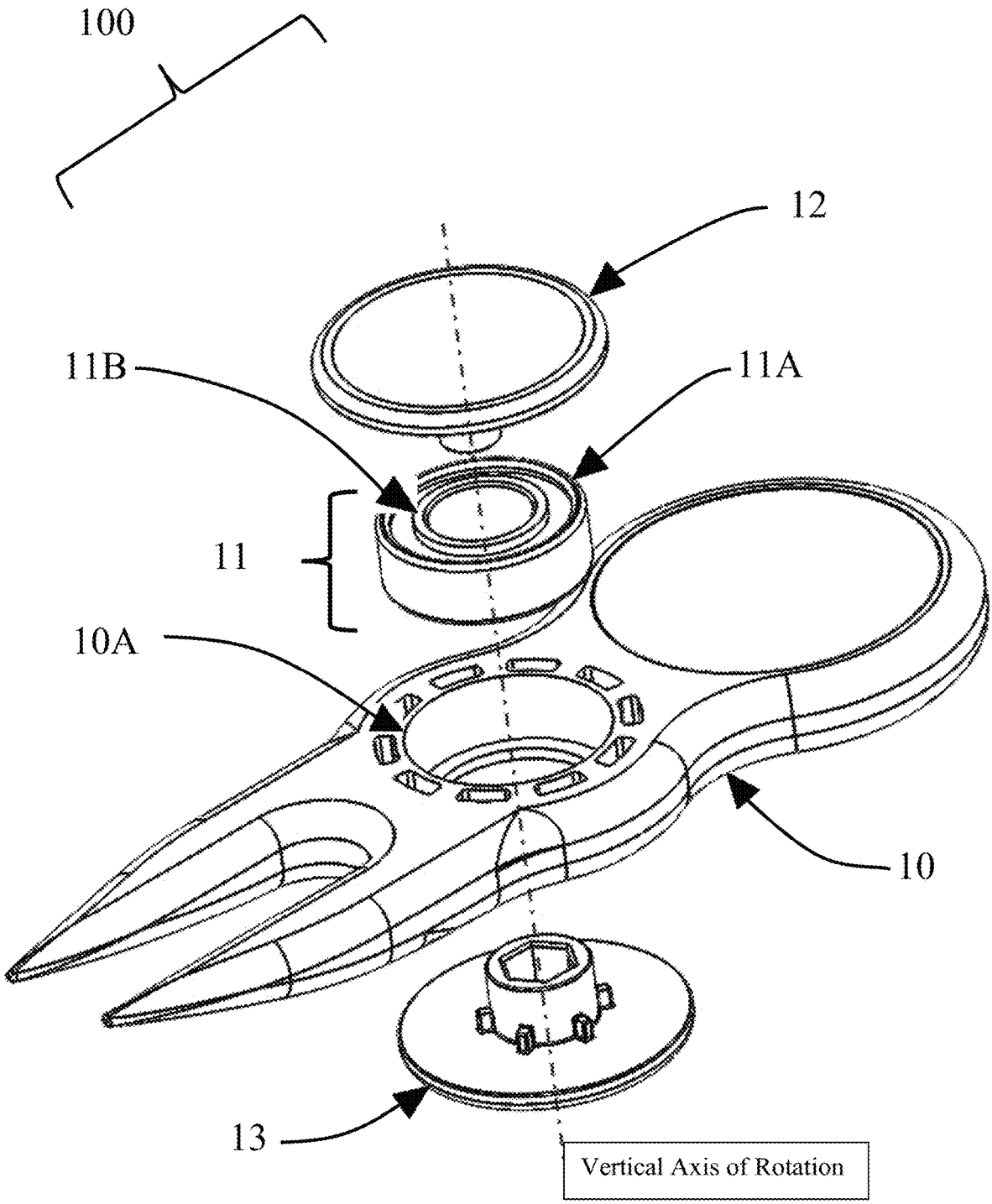
FIG. 2—FIG. 2 illustrates an exploded perspective view of the preferred embodiment of the putting green repair accessory with slope indicating feature.

The present invention will now be described by referencing the appended figures representing preferred embodiments. FIG. 1 depicts a perspective view of the preferred embodiment of the putting green repair accessory with slope indicating feature 100 (the "accessory") illustrating the vertical axis of rotation. FIG. 2 depicts an exploded perspective view of the elements that may comprise the accessory 100. In preferred embodiments, the vertical axis of rotation of accessory 100, as established by the recessed bearing pocket 10A of the elongate body 10, is not coincidental with the accessory CoM. The accessory vertical axis of rotation is, however, coincidental with the central rotation axes of the remaining components that may comprise the accessory, they include; rolling-element bearing 11, second pedestal 12, first pedestal 13. Alternative embodiments may employ a through hole in lieu of a recessed pocket to establish the vertical axis of rotation. In preferred embodiments, the elongate body 10, the second pedestal 12 and first pedestal 13 are all produced using injection molding processes and equipment with ABS, Polyoxymethylene (POM) or other suitable plastic material. The rolling-element bearing 11 is one commonly used in the transportation and motion control industries, as such, its design is well known to those skilled in the art. Rolling-element bearings are commonly made from chrome steel and/or ceramic materials.

Figure 3:
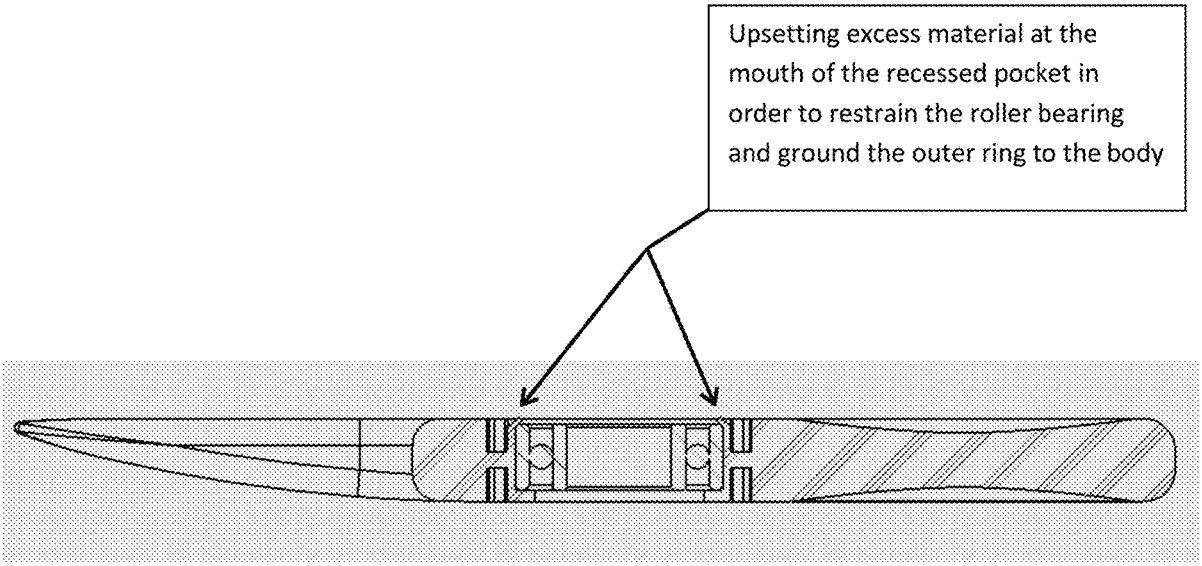
FIG. 3 AND 3A—FIG. 3 illustrates how the mechanical deformation of excess material can be used to simultaneously restrain the rolling-element bearing and hold the outer race motionless (grounded) with respect to the elongate body of the putting green repair accessory with slope indicating feature.

Referring still to FIG. 2, assembly commences by installation of the rolling-element bearing 11 into the recessed pocket 10A of elongate body 10 wherein the outer race 11A of rolling-element bearing 11 is in close proximity to the vertical side walls of the recessed pocket 10A of elongate body 10. The design of recessed pocket 10A is such that the lower surface of the rolling-element bearing outer race 11A rests on the bottom horizontal surface of recessed pocket 10A while the inner race 11B of rolling-element bearing 11 is sufficiently distant from any portion of the elongate body 10. As illustrated in FIG. 3, excess material at the mouth of recessed pocket 10A is mechanically upset inwardly to restrain rolling-element bearing 11 to the elongate body 10. Further, the restraining method is also used to maintain outer race 11A in a grounded position with respect to the elongate body 10. In this state, inner race 11B of rolling-element bearing 11 can rotate freely with respect to the mechanically combined outer race 11A and elongate body 10. Additional methods of restraining rolling-element bearing 11 to elongate body 10 may include adhesives, fasteners and/or the use of interference, or press-fit, relationships between features of rolling-element bearing 11 (inner or outer race) and the elongate body 10. It is further noted, that with slight design modifications to the mating components either the inner race, 11B, or the outer race, 11A, of the rolling element bearing, 11, can be selected for free rotation or grounding to elongate body 10.

The assembly continues when the protruding boss of first pedestal 13 is slidably inserted into the inner diameter of rolling-element bearing 11. Cylindrically arranged radial ribs surrounding the base of the protruding boss come to rest against the lower surface of inner race 11B thereby establishing a gap between the underside of first pedestal 13 and the bottom surface of elongate body 10.

Figure 3A:
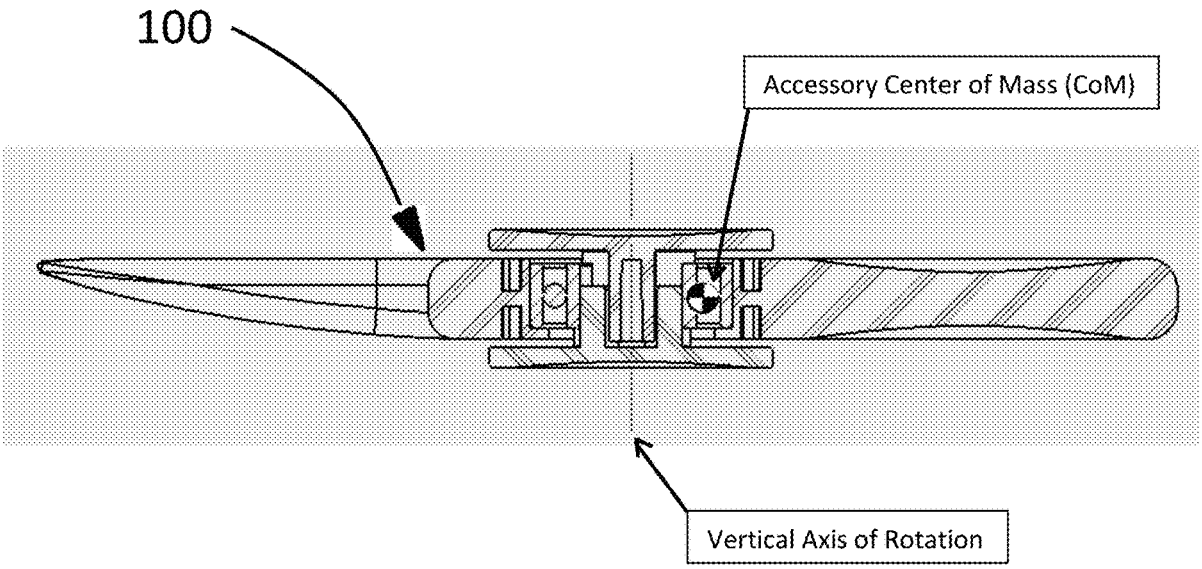

To complete the assembly, the protruding pin of second pedestal 12 is slidably inserted into the central socket of first pedestal 13. The insertion continues using two sets of cylindrically arranged radial ribs on the underside of second pedestal 12. The first set pilot into the inner diameter of rolling-element bearing 11 and the second come to rest against the upper surface of inner race 11B thereby establishing a gap between the underside of the second pedestal 12 and the top surface of elongate body 10. The sizing of the pin and socket arrangement is such that a slight interference is created thereby preventing non-intentional disassembly. Additional methods such as adhesive or fasteners may be used to prevent non-intentional disassembly. FIG. 3A depicts a sectioned side view of the accessory showing the final arrangement of the components along the vertical axis of rotation, as well as, the accessory CoM.

Figure 4:
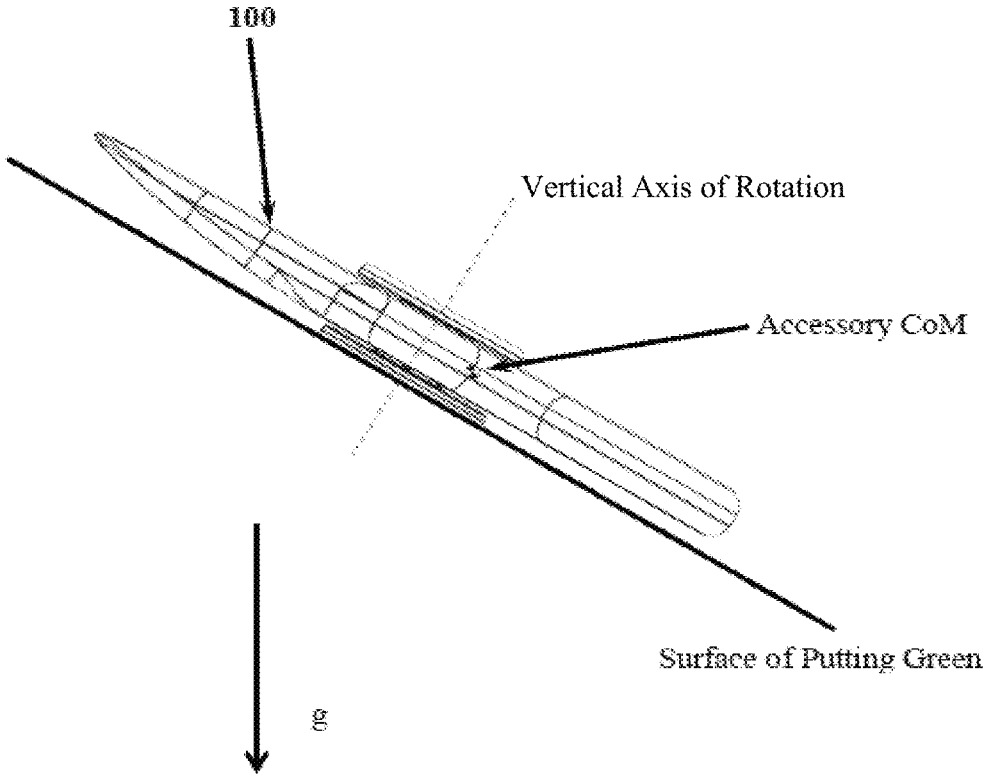
FIG. 4—FIG. 4 illustrates how the elongate body of putting green repair accessory with slope indicating feature will align with the direction of the slope due to gravity. On a detectable slope, gravity acting on the accessory CoM will cause the elongate body to rotate about the vertical axis of rotation thereby aligning the elongate body with the direction of the slope in the vicinity of the accessory.

The green repair feature of accessory 100 is enabled by the tine(s) which protrude from elongate body 10, this method is well known and used in nearly all embodiments of putting green repair or divot tools. The distal end of the elongate body 10 can be adapted for numerous purposes such as displaying a logo and/or storing and retaining a ball marker. The novel slope indicating feature of the putting green repair accessory with slope indicating feature is enabled by two primary characteristics which manifest in the assembled configuration of accessory 100. Since the accessory behaves as a rigid body, the forces due to gravity act on the accessory CoM. The rotational freedom between elongate body 10, where the CoM is located, and the conjoined pedestals enables the elongate body 10 to independently rotate in response to gravity; thereby indicating the direction of the putting green slope in the immediate vicinity of the accessory. As illustrated in FIG. 4, when the accessory is placed onto a putting green with detectable slope, the accessory CoM seeks to find its lowest position thereby causing the elongate body 10 to rotate about the vertical axis of rotation thereby aligning the elongate body 10 with the direction of the slope.

The sensitivity to slope detection can be manipulated by changing the location of the accessory CoM using any number of possible strategies. One possible method is to increase the mass at the distal end of elongate body 10 through the addition of design features or part thickness.

Figure 5:
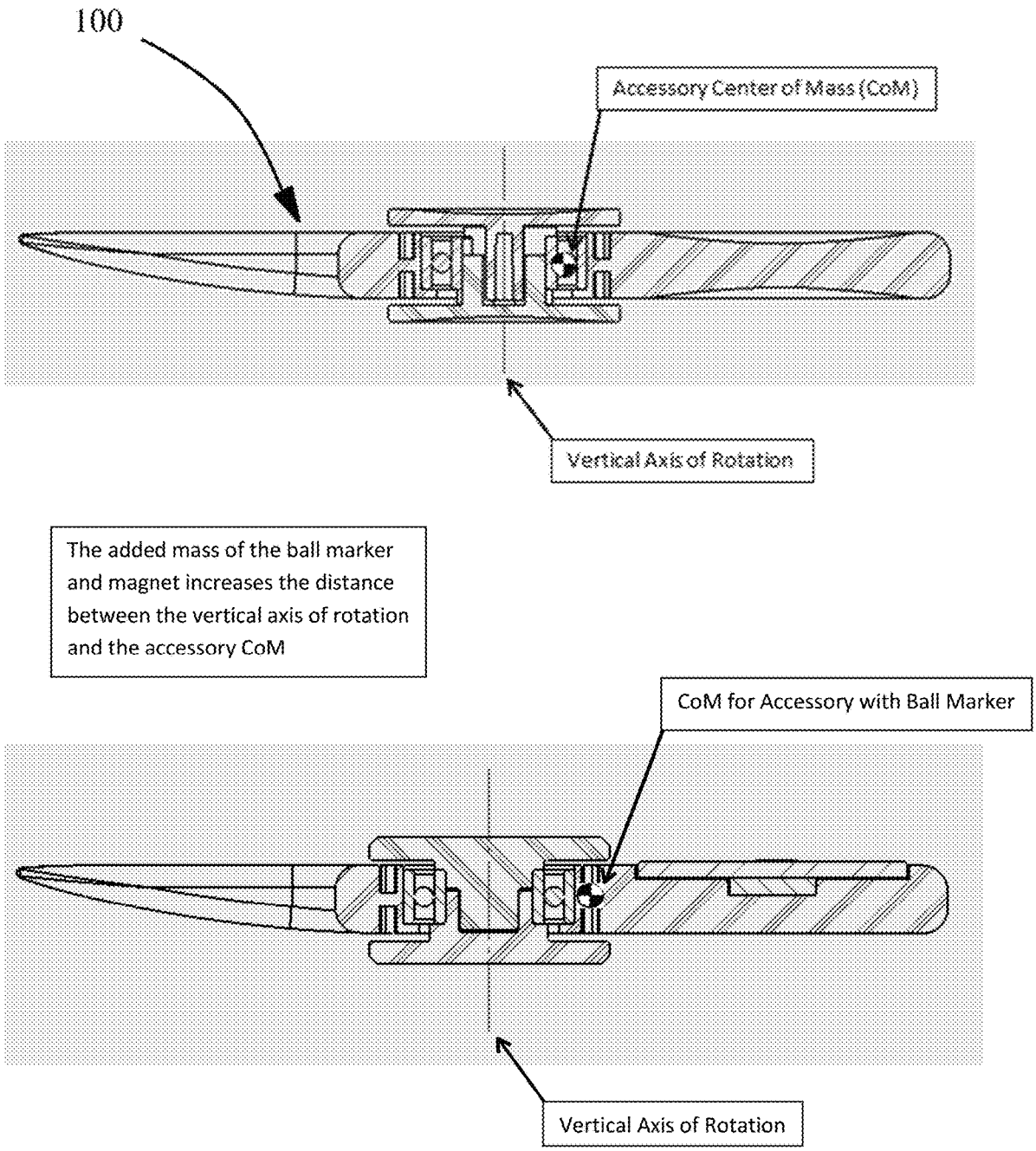
FIGS. 5, 5A, and 5B—FIG. 5 illustrates how the addition of mass to the elongate body of the putting green repair accessory with slope indicating feature affects the location of the accessory CoM. The horizontal distance between the vertical axis of rotation and the accessory CoM is directly related to the slope detection sensitivity.
Figure 5A:
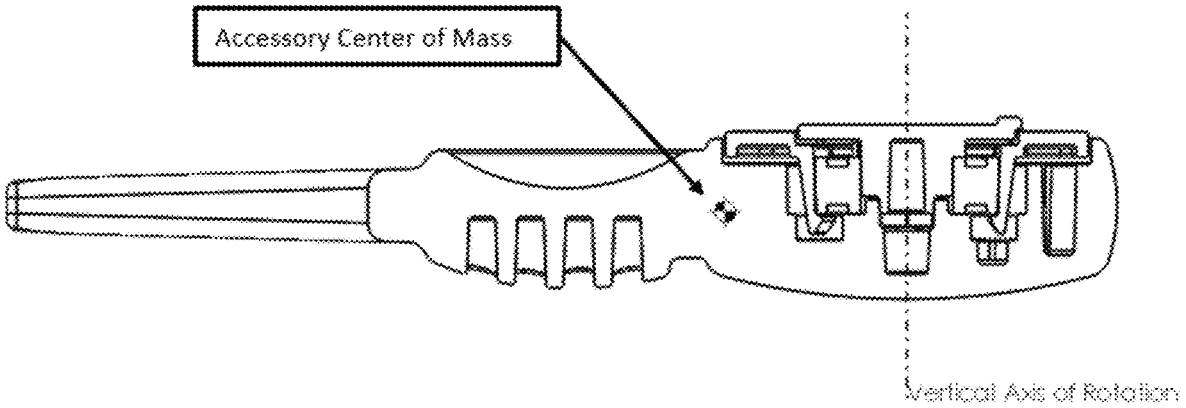
Figure 5B:
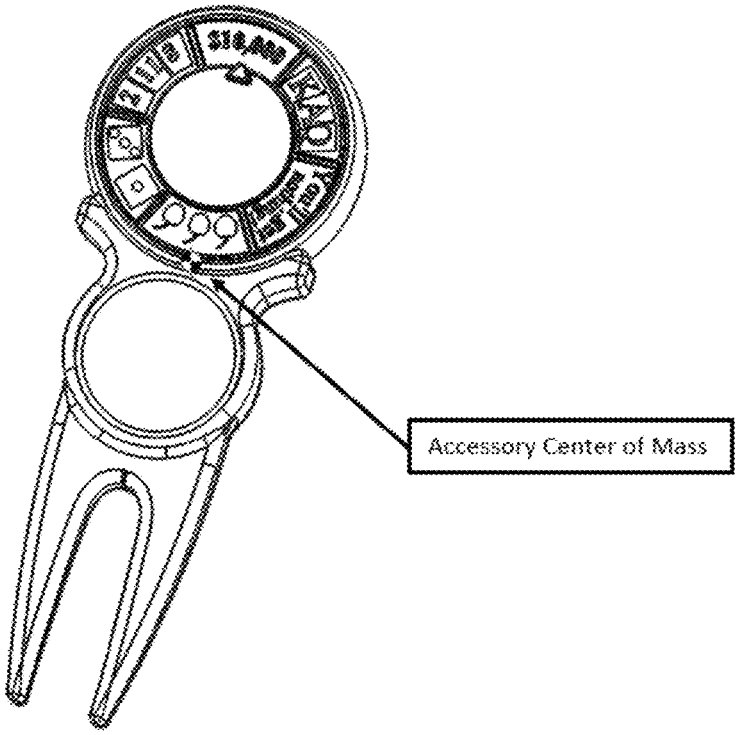

Increasing or decreasing the separation between the vertical axis of rotation and the accessory CoM has the effect of increasing or decreasing slope detection sensitivity. For example, a separate embodiment of the accessory may include a metallic ball marker and magnet. Adding these components to a particular design has the effect of moving the accessory CoM away from the vertical axis of rotation and toward the distal end. FIG. 5 compares the CoM locations with respect to the vertical axis of rotation for the preferred embodiment 100, as well as, a similar embodiment that incorporates a typical metal ball marker and magnet.

Figure 6A:
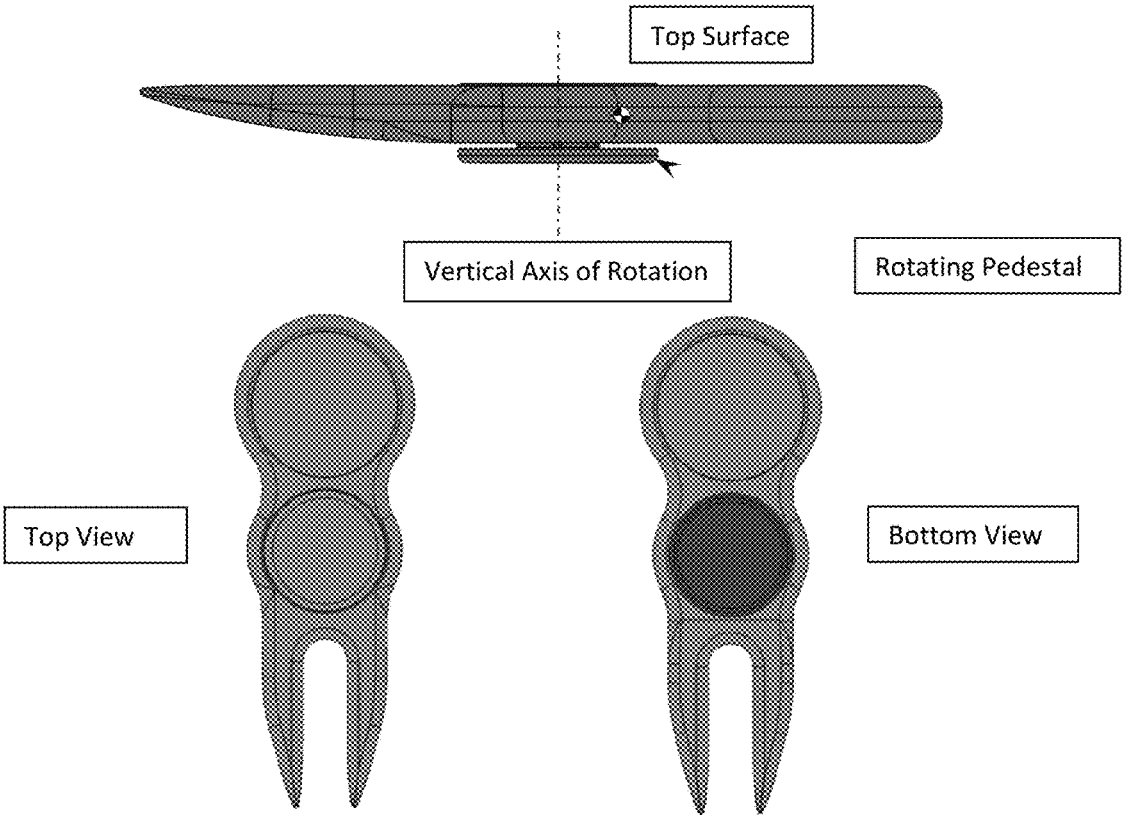
FIGS. 6A and 6B—FIG. 6A illustrates an alternate embodiment of the putting green repair accessory with slope indicating feature in that the first pedestal rotates independently from the elongate body. Therefore, when placed onto a putting green the elongate body can freely rotate in response to gravitational forces that are applied at the CoM.

Referring now to FIG. 6A, an additional embodiment of the present invention wherein a green repair accessory with slope indicating feature that uses one rotating (first) pedestal is illustrated. In this embodiment, the second pedestal is integrated into the elongate body perhaps with a depression for locating one's thumb or finger, while the first pedestal is coupled with the freely rotating race of the rolling-element bearing. To indicate the presence and/or direction of the putting green slope, in the immediate vicinity of the accessory, the accessory is placed onto the putting green surface with the first pedestal in contact with the putting green thereby allowing the elongate body to rotate independently in response to gravitational forces.

Figure 6B:
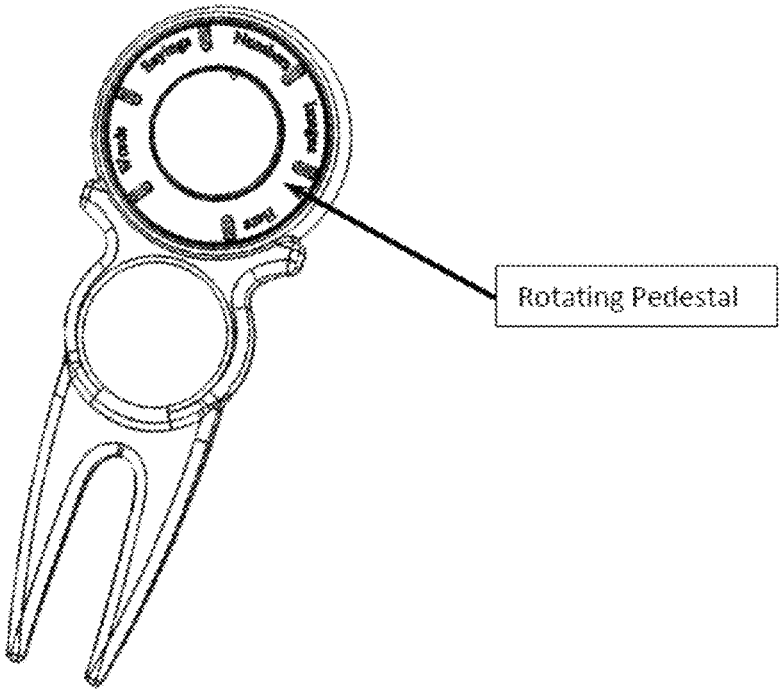

Referring now to FIG. 6B which illustrates an alternate embodiment of a putting green repair accessory wherein the first pedestal is set to spinning with a swipe of the user's finger. The pedestal is coupled with the freely rotating race of the rolling-element bearing and once the pedestal comes to rest, a pointer leads the user to read a confidence building quote or humorous phrase that has been applied to the pedestal.

Figure 7:
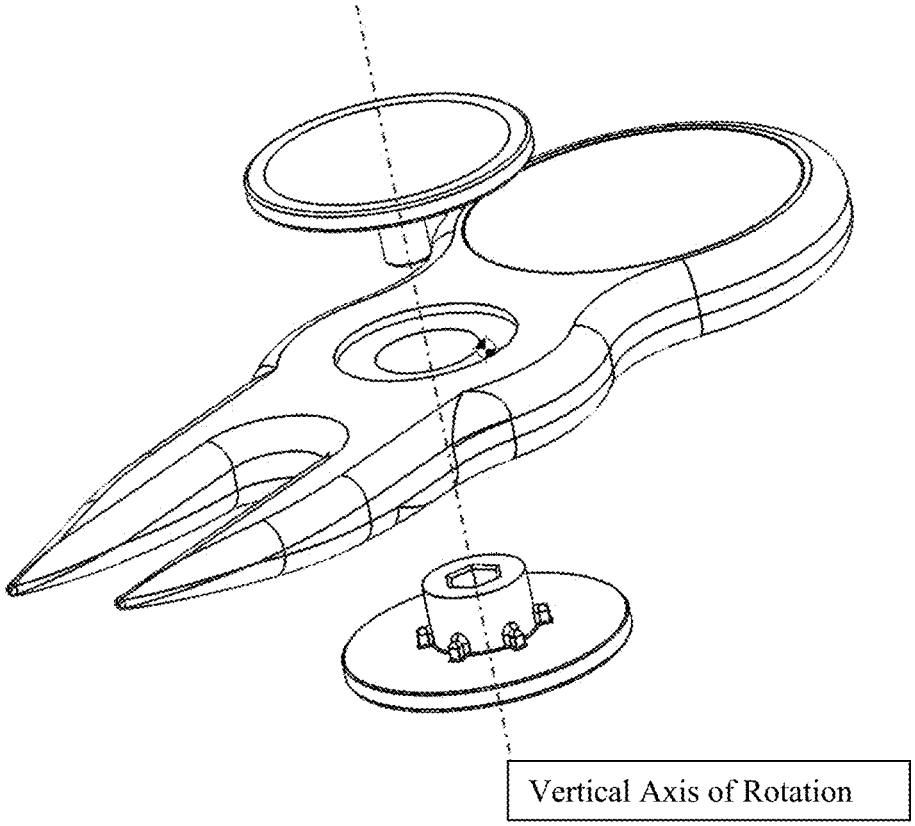
FIGS. 7, 7A and 7B—FIG. 7 is an exploded perspective view of an alternate embodiment of the putting green repair accessory with slope indicating feature utilizing a plain bearing and a journal which is formed by the conjoined second and first pedestals. In this embodiment, materials that exhibit very low friction coefficients should be selected in order to provide adequate rotational freedom and thereby slope detection sensitivity.
Figure 7A:
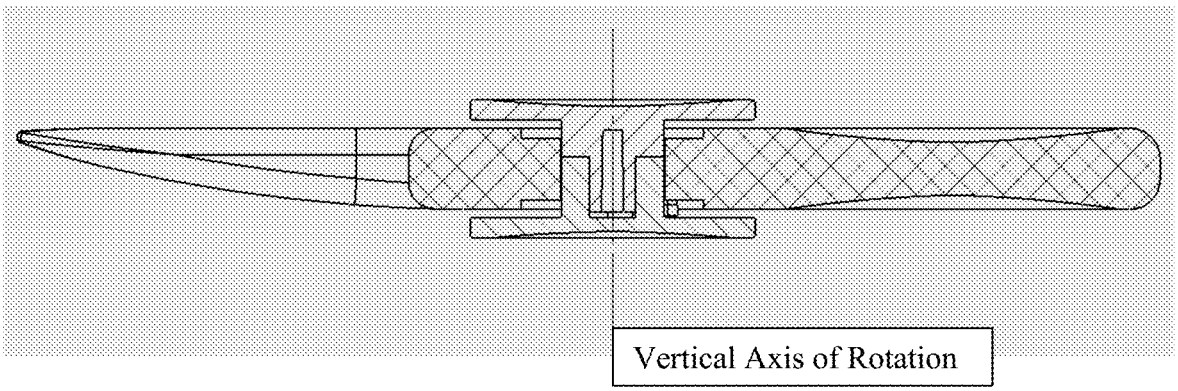
Figure 7B:
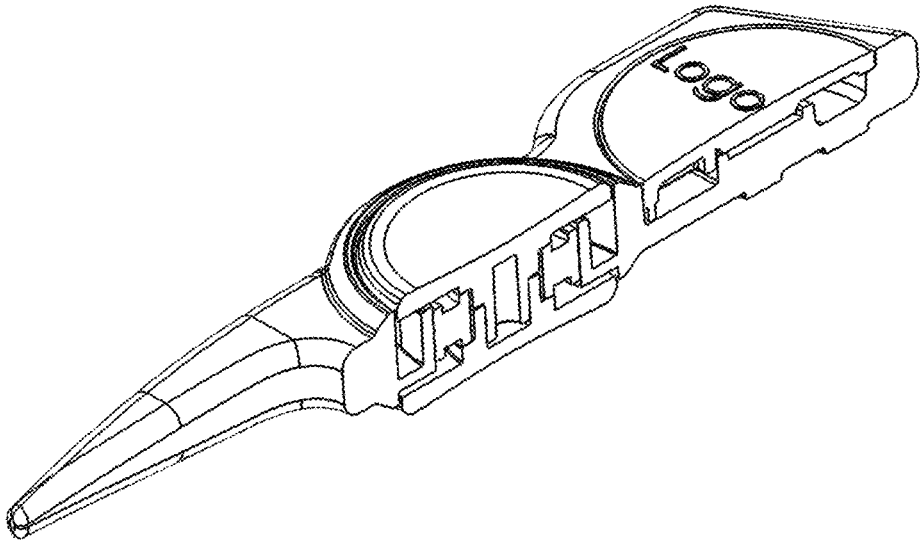

FIGS. 7, 7A, and 7B illustrate additional embodiments of the present invention comprising a putting green repair tool, plain bearing, and bearing journal. FIG. 7 illustrates an embodiment wherein the first and second pedestals are adapted to couple together and form a bearing journal about which the elongate body will rotate in response to gravitational forces. To ensure adequate slope indicating ability, fluoropolymer type materials exhibiting low friction coefficients may be chosen to form the bearing journal and/or the plain bearing. Alternatively, FIG. 7B illustrates another embodiment wherein the through hole shown in the elongate body is used to house a rolling-element bearing, retention of the bearing is accomplished using any of the methods previous discussed.

While preferred materials for elements have been described, the device is not limited by these materials. Wood, plastics, metal alloys, aluminum and other materials may comprise some or all of the elements of the combination green repair tool and slope indicating accessory in various embodiments of the present invention.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A putting green repair accessory comprising:

a rolling-element bearing having an inner race and an outer race, the inner and outer races each having upper and lower surfaces; and an elongate body having a top surface and a bottom surface, at least one tine protruding from one end of the elongate body thereof forming a putting green repair tool with a distal end being opposite the tined end, the elongate body further comprising a recessed pocket for housing and fixedly restraining portions of the rolling-element bearing, the recessed pocket further comprising a closed surface and a central axis with the central axis thereby establishing a vertical axis of rotation, the origin of the recessed pocket being coincident with one of either the top surface or the bottom surface whereby the center of mass of the putting green repair accessory being located between the central axis of the recessed pocket and the distal end; and a first pedestal, the first pedestal is adapted to couple with the rolling-element bearing.

2. The putting green repair accessory of claim 1 further comprising:

an axially aligned hole connecting the closed surface of the recessed pocket with the surface of the elongate body being opposite the surface whereon the origin of the recessed pocket is located; and a second pedestal, the second pedestal is adapted to couple with the first pedestal.

3. The putting green repair accessory of claim 1 further comprising a means for storing and retaining a ball marker within the distal end of the elongate body.

4. The putting green repair accessory of claim 3 further comprising a metallic ball marker and magnet.

5. The putting green repair accessory of claim 2 further comprising a means for storing and retaining a ball marker within the distal end of the elongate body.

6. The putting green repair accessory of claim 5 further comprising a metallic ball marker and magnet.

7. A putting green repair accessory comprising:

a rolling-element bearing having an inner race and an outer race, the inner and outer races each having upper and lower surfaces; and an elongate body having a top surface and a bottom surface, at least one tine protruding from one end of the elongate body thereof forming a putting green repair tool with a distal end being opposite the tined end, the elongate body further comprising a recessed pocket for housing and fixedly restraining portions of the rolling-element bearing, the recessed pocket further comprising a closed surface and a central axis with the central axis thereby establishing a vertical axis of rotation, the origin of the recessed pocket being coincident with one of either the top surface or the bottom surface whereby the center of mass of the putting green repair accessory being located between the central axis of the recessed pocket and the tined end; and a first pedestal, the first pedestal is adapted to couple with the rolling-element bearing.

8. The putting green repair accessory of claim 7 further comprising:

an axially aligned hole connecting the closed surface of the recessed pocket with the surface of the elongate body being opposite the surface whereon the origin of the recessed pocket is located; and a second pedestal, the second pedestal is adapted to couple with the first pedestal.

9. The putting green repair accessory of claim 7 further comprising a means for storing and retaining a ball marker within the distal end of the elongate body.

10. The putting green repair accessory of claim 9 further comprising a metallic ball marker and magnet.

11. The putting green repair accessory of claim 8 further comprising a means for storing and retaining a ball marker within the distal end of the elongate body.

12. The putting green repair accessory of claim 11 further comprising a metallic ball marker and magnet.

13. A putting green repair accessory comprising:

a rolling-element bearing having an inner race and an outer race, the inner and outer races each having upper and lower surfaces; and an elongate body having a top surface and a bottom surface, at least one tine protruding from one end of the elongate body thereof forming a putting green repair tool with a distal end being opposite the tined end, the elongate body further comprising a through hole for housing and fixedly restraining portions of the rolling-element bearing, the through hole further comprising a central axis with the central axis thereby establishing a vertical axis of rotation, the origin of the through hole being coincident with one of either the top surface or the bottom surface whereby the center of mass of the putting green repair accessory being located between the central axis of the through hole and the distal end; and a first pedestal, the first pedestal is adapted to couple with the rolling-element bearing.

14. The putting green repair accessory of claim 13 further comprising a second pedestal, the second pedestal is adapted to couple with the first pedestal.

15. The putting green repair accessory of claim 13 further comprising a means for storing and retaining a ball marker within the distal end of the elongate body.

16. The putting green repair accessory of claim 15 further comprising a metallic ball marker and magnet.

17. The putting green repair accessory of claim 14 further comprising a means for storing and retaining a ball marker within the distal end of the elongate body.

18. The putting green repair accessory of claim 17 further comprising a metallic ball marker and magnet.

19. A putting green repair accessory comprising:

a rolling-element bearing having an inner race and an outer race, the inner and outer races each having upper and lower surfaces; and an elongate body having a top surface and a bottom surface, at least one tine protruding from one end of the elongate body thereof forming a putting green repair tool with a distal end being opposite the tined end, the elongate body further comprising a through hole for housing and fixedly restraining portions of the rolling-element bearing, the through hole further comprising a central axis with the central axis thereby establishing a vertical axis of rotation, the origin of the through hole being coincident with one of either the top surface or the bottom surface whereby the center of mass of the putting green repair accessory being located between the central axis of the through hole and the tined end; and a first pedestal, the first pedestal is adapted to couple with the rolling-element bearing.

20. The putting green repair accessory of claim 19 further comprising a second pedestal, the second pedestal is adapted to couple with the first pedestal.

21. The putting green repair accessory of claim 19 further comprising a means for storing and retaining a ball marker within the distal end of the elongate body.

22. The putting green repair accessory of claim 21 further comprising a metallic ball marker and magnet.

23. The putting green repair accessory of claim 20 further comprising a means for storing and retaining a ball marker within the distal end of the elongate body.

24. The putting green repair accessory of claim 23 further comprising a metallic ball marker and magnet.

* * * * *